United States Patent [19]

Baur et al.

[11] 4,212,760

[45] Jul. 15, 1980

[54] SOLUBILIZED ALKALINE, AQUEOUS SOLUTIONS OF NONIONIC SURFACTANTS

[75] Inventors: Richard Baur, Mannheim; Knut Oppenlaender; Dieter Stoeckigt, both of Ludwigshafen, all of Fed. Rep. of Germany

[73] Assignee: BASF Aktiengesellschaft, Fed. Rep. of Germany

[21] Appl. No.: 967,101

[22] Filed: Dec. 7, 1978

[30] Foreign Application Priority Data

Dec. 7, 1977 [DE] Fed. Rep. of Germany ..... 2754359

[51] Int. Cl.[2] ..... C11D 1/66; C11D 3/20

[52] U.S. Cl. ..... 252/156; 252/174.21

[58] Field of Search ..... 252/156, 89 R, DIG. 1, 252/DIG. 14, 174.21

[56] References Cited

U.S. PATENT DOCUMENTS

| | | | |
|---|---|---|---|
| 3,156,655 | 11/1964 | Bright | 252/DIG. 14 X |
| 3,294,693 | 12/1966 | Dupre et al. | 252/156 X |
| 3,382,178 | 5/1968 | Lissant et al. | 252/156 X |
| 3,705,856 | 12/1972 | Sedliar et al. | 252/156 |
| 3,816,351 | 6/1974 | Lancz | 252/DIG. 1 X |
| 3,956,161 | 5/1976 | Woodward | 252/156 |
| 3,966,628 | 6/1976 | Woodward | 252/135 |
| 4,062,814 | 12/1977 | Hansen | 252/156 X |
| 4,137,190 | 1/1979 | Chakrabarti et al. | 252/DIG. 1 X |

*Primary Examiner*—Harris A. Pitlick
*Attorney, Agent, or Firm*—Keil & Witherspoon

[57] ABSTRACT

To prevent the salting-out of nonionic surfactants from strongly alkaline (pH>9) aqueous solutions, solubilizers have been proposed but existing solubilizers do not have a sufficiently broad action spectrum. The invention seeks to provide solubilizers having a broader action spectrum and provides for this purpose monocarboxylic acids of 6 to 11 carbon atoms optionally in admixture with ene-adducts of maleic anhydride and unsaturated fatty acids of 12 to 24 carbon atoms or their triglycerides. The solutions are useful as cleansers and in the textile industry.

5 Claims, No Drawings

SOLUBILIZED ALKALINE, AQUEOUS SOLUTIONS OF NONIONIC SURFACTANTS

The present invention relates to a process for the preparation of a strongly alkaline, aqueous solution of a nonionic surfactant using a solubilizer.

Nonionic surfactants cannot be incorporated directly into strongly alkaline surfactant formulations. They are effectively salted out by the high electrolyte content, ie. they form a separate phase from the aqueous phase. A solubilizer is required if they are nevertheless to be dissolved. Useful solubilizers have proved to be alkylarylsulfonates, eg. cumenesulfonates, and ene-adducts of maleic anhydride with α-olefins, eg. with Δ-1,2-dodecene, as well as Diels-Alder adducts of linoleic acid with acrylic acid (cf. U.S. Pat. No. 3,956,161). However, they are of limited applicability for a variety of surfactant categories.

The present invention seeks to provide a solubilizer for the above purpose having a broader action spectrum, ie. a solubilizer which is suitable for more nonionic surfactant categories and/or wider alkalinity ranges. According to the present invention there is provided a clear strongly alkaline aqueous solution of a nonionic surfactant containing from 1 to 10 parts by weight, per part by weight of nonionic surfactant, of a monocarboxylic acid of 6 to 11 carbon atoms or of a mixture of such a carboxylic acid with from 5 to 100% of its weight of an ene-adduct of maleic anhydride with an unsaturated fatty acid of 12 to 24 carbon atoms or a triglyceride thereof.

The invention further provides a process for the preparation of a strongly alkaline, aqueous solution of a nonionic surfactant by mixing the surfactant, aqueous sodium hydroxide solution and a solubilizer and if necessary diluting with water, wherein at least a major proportion by weight of the solubilizer is a monocarboxylic acid of 6 to 11 carbon atoms, the weight ratio solubilizer:surfactant being from 1:1 to 10:1.

For the purposes of the present invention the expression "strongly alkaline aqueous solution" means a solution of pH greater than 9, preferably greater than 12. For economic reasons, only sodium hydroxide solution is used in practice, even though in principle any alkali hydroxide can be used.

The monocarboxylic acids of 6 to 11, preferably of 7 to 9, carbon atoms which are used according to the invention may be aliphatic or aromatic, olefinically unsaturated or, preferably, saturated, and open-chain (non-branched or branched) or cyclic. Specific examples are caproic acid, enanthic acid, caprylic acid, pelargonic acid, capric acid, undecanoic acid, undecylenic acid, cyclohexanemonocarboxylic acid, benzoic acid and toluic acid. 2-Ethylhexanoic acid and, preferably, its mixture with from 0.05 to 1, especially from 0.1 to 0.2, times its amount by weight of an ene-adduct of maleic anhydride with an unsaturated fatty acid of 12 to 24 carbon atoms, or with a triglyceride of such an acid, have proved very particularly suitable.

The ene-adducts may be prepared in the conventional manner by thermal addition reaction of maleic anhyride with an appropriate unsaturated fatty acid or with an appropriate natural oil (fatty acid triglyceride), with from about 0.4 to 2, preferably from 0.7 to 1, mole of maleic anhydride undergoing adduct formation per mole of unsaturated fatty acid, regardless of the number of double bonds in the latter. The adduct formation can, for example, be carried out in boiling toluene, preferably in the presence of a catalytic amount of iodine (cf., for example, A. E. Rheineck and T. H. Khoe, "Fette, Seifen, Anstrichmittel" 71, (1969) 644–652 and U.S. Pat. No. 2,188,882). The unsaturated acid must be of 12 to 24, preferably of 14 to 18, carbon atoms and must contain one or more olefinic double bonds. Preferably, not more than one mole of maleic anhydride is caused to undergo adduct formation per double bond, though the reaction of a larger amount of maleic anhydride would be entirely possible, since it is not the double bond of the fatty acid, but the double bond of the maleic anhydride, which becomes saturated as a result of the adduct formation. Examples of suitable unsaturated fatty acids are especially oleic acid (cis-Δ-9,10-octadecenoic acid), but also its trans-isomer elaidic acid, and lauroleic acid (Δ-4,5-dodecenoic acid), myristoleic acid (Δ-9,10-tetradecenoic acid), palmitoleic acid (Δ-9,10-hexadecenoic acid, gadoleic acid (Δ-9,10-eicosenoic acid), erucic acid (Δ-13,14-docosenoic acid) and selacholeic acid (Δ-15,16-tetracosenoic acid). Examples of suitable fatty acids having 2 or more olefinic double bonds are especially linoleic acid (Δ-9,10-12,13-octadecadienoic acid) and linolenic acid (Δ-9,10-12,13-15,16- octadecatrienoic acid). It is true that other acids can also be employed, but their practical importance is rather less.

Instead of the free acids it is also possible, as already mentioned, to use their triglycerides in the manufacture of the ene-adducts, ie. especially natural fats and in particular oils which contain a predominant proportion (more than 50 mole%, preferably more than 75 mole%, based on the total fatty acids present in the mixture) of the above unsaturated fatty acids as esters. Examples of suitable products are linseed oil, olive oil, castor oil, groundnut oil, sesame oil, corn germ oil, sunflower oil, soybean oil, poppyseed oil, cottonseed oil, hemp oil and palm oil, as well as the various animal fats and especially animal oils, eg. fish oil, whale oil and sperm oil. The last-mentioned product contains, in addition to glycerides, substantial proportions of esters of wax alcohols, including unsaturated alcohols. These compounds are also suitable starting materials.

On dissolving in an aqueous alkaline medium, the anhydride groups of the maleic anhydride which has undergone adduct formation hydrolyze to carboxylate groups which, together with the original carboxyl groups of the unsaturated fatty acids, which are now also salinated, ensure the solubility of the products employed according to the invention. The solubilizing action is evidently based on the simultaneous presence (in a suitably balanced ratio) of these (hydrophilic) carboxylate groups and of the lipophilic part of the molecule.

It is true that the ene-adducts themselves, ie. without admixture of monocarboxylic acids of 6 to 11 carbon atoms, are also effective solubilizers, but the action of the mixtures encompasses a broader spectrum, ie. the mixtures are effective in the case of a larger number of surfactants. In particular the superiority of the mixtures manifests itself at higher alkali concentrations. Furthermore, the pure ene-adducts, (ie. without admixture of monocarboxylic acids), are of less interest for economic reasons.

The solubilizers proposed according to the invention may be used in conjunction with a wide variety of nonionic surfactants, in particular with the numerous commercial ethylene oxide adducts and propylene oxide adducts and their mixed adducts (which are mostly not random adducts but block adducts) with monofunctional, difunctional and polyfunctional alcohols, amines, polyamines, aminoalcohols, carboxylic acids, acid amides and alkylphenols, and block copolymers of ethylene oxide and propylene oxide, ethylene oxide and butylene oxide, or ethylene oxide, propylene oxide and butylene oxide.

To test the activity of the solubilizers, the latter are mixed with from 0.1 to 1, preferably from 0.3 to 1, part by weight of nonionic surfactant per part of solubilizer and this mixture in turn is mixed with an equal amount by weight of 20 or 30% strength aqueous sodium hydroxide solution to see whether an optically clear solution is formed. Experience has shown that if this is the case, no clouding or phase separation occurs even on standing for several weeks.

In practice, the solubilizers are employed in a similar manner, but of course the relative amount of sodium hydroxide solution, and its concentration, can vary.

In cases where the mixture of solubilizer, surfactant and sodium hydroxide solution, in the stated concentration, is pasty, a clear solution can as a rule be obtained by dilution with water.

The solutions according to the invention may be used, for example, as cleansers for heavy greasy soiling or in the textile industry, e.g. as a feeding liquor for cotton pretreatment.

In the Examples and Comparative Experiments which follow, parts and percentages are by weight.

EXAMPLES 1 TO 11 AND COMPARATIVE EXPERIMENTS

In each case 7 parts of solubilizer and 3 parts of surfactant were dissolved in 10 parts of 20% strength aqueous sodium hydroxide solution, with stirring but without heating except for a slight spontaneous exothermicity, and the mixtures were assessed visually as to whether a clear solution (+), an incomplete, ie. cloudy, solution (−) or a pasty emulsion (P), which on dilution with water gives a clear solution, was formed. Further details and the results are shown in Table I.

Table I

| | SOLUBILIZER | | | | | | |
|---|---|---|---|---|---|---|---|
| | Comparative Experiments | | | Examples | | | |
| Surfactant | Na-cumene-sulfonate | Dodecyl-succinic anhydride | Ethyl-hexan-oic acid/ oleic acid-MA adduct, 1:9 (by weight) | 1. Cap-roic acid | 2. Cyclo-hexane-carboxy-lic acid | 3. Ethyl-hexa-noic acid | 4. Isono-nanoic acid (techni-cal iso-mer mix-ture). |
| 30 PO + 4.5 EO | − | P | + | + | + | + | + |
| 30 PO + 110 EO | − | − | + | + | + | + | + |
| 30 PO + 30 EO | − | − | + | + | + | + | + |
| 30 PO + 150 EO | − | − | − | P | + | + | − |
| 30 EO + 40 PO | − | − | − | P | + | + | − |
| Ethylenediamine (ED) + 17 PO + 15 EO (Hlock) | − | − | − | + | + | + | + |
| ED + 55 PO + 8 EO | − | + | + | + | + | + | + |
| ED + 52 PO + 160 EO | − | − | − | + | + | + | − |
| ED + 100 PO + 15 EO | − | − | + | P | + | + | + |
| $C_{9/11}$-Oxo alcohol + 3 EO | + | − | + | + | + | + | + |
| $C_{9/11}$-Oxo alcohol + 7 EO | − | − | + | + | + | + | + |
| $C_{9/11}$-Oxo alcohol + 10 EO | − | − | + | + | + | + | + |
| $C_{9/18}$-Oxo alcohol + 4 PO | − | − | − | + | + | + | + |
| $C_{9/18}$-Oxo alcohol + 7 PO | − | − | − | + | + | + | − |
| $C_{9/18}$-Oxo alcohol + 13 PO | − | − | − | − | − | + | + |
| Nonylphenol + 7 EO | − | − | + | + | + | + | + |
| Nonylphenol + 10 EO | − | − | + | + | + | + | + |
| Nonylphenol + 14 EO | − | − | + | + | + | + | + |

| | Examples | | | | | | |
|---|---|---|---|---|---|---|---|
| Surfactant | 5. Cap-ric acid | 6. Unde-cylenic acid | 7. Ben-zoic acid | 8. p-Tol-uic acid | 9. Naph-thal-ene-car-boxy-lic acid | 10. Ethyl-hexan-oic acid/ oleic acid-MA adduct, 1:9 (by weight) | 11. Ethyl-hexan-oic acid/ oleic acid-MA adduct, 1:1) by weight) |
| 30 PO + 4.5 EO | P | P | P | P | P | + | + |
| 30 PO + 110 OE | P | P | P | P | P | + | + |
| 30 PO + 30 EO | P | P | P | P | P | + | + |
| 30 PO + 150 EO | − | P | P | P | P | + | − |
| 30 EO + 40 PO | P | P | − | P | P | + | + |
| Ethylenediamine (ED) + 17 PO + 15 EO (Hlock) | P | P | P | P | − | + | + |
| ED + 55 PO + 8 EO | P | P | P | P | P | + | + |

Table I-continued

| | SOLUBILIZER | | | | | | |
|---|---|---|---|---|---|---|---|
| ED + 52 PO + 160 EO | P | P | P | P | P | + | − |
| ED + 100 PO + 15 EO | − | P | P | P | − | + | + |
| $C_{9/11}$-Oxo alcohol + 3 EO | P | P | P | P | P | + | + |
| $C_{9/11}$-Oxo alcohol + 7 EO | P | − | P | P | − | + | + |
| $C_{9/11}$-Oxo alcohol + 10 EO | − | − | P | P | P | + | + |
| $C_{9/11}$-Oxo alcohol + 4 PO | P | P | P | P | P | + | + |
| $C_{9/10}$-Oxo alcohol + 7 PO | − | P | P | P | − | + | − |
| $C_{9/18}$-Oxo alcohol + 13 PO | − | − | − | − | P | + | − |
| Nonylphenol + 7 EO | P | P | P | P | P | + | + |
| Nonylphenol + 10 EO | P | P | P | P | P | + | + |
| Nonylphenol + 14 PO | P | P | P | P | P | + | + |

x EO + y PO means that y moles of propylene oxide have undergone adduct formation with a polymer of x moles of ethylene oxide
+ = clear solution
P = cloudy solution
oleic acid-MA adducts = adduct of 1 mole of maleic anhydride with 1 mole of oleic acid
1:1 (by weight) = mixture of two equal amounts by weight

EXAMPLES 12 TO 22 AND COMPARATIVE EXPERIMENT

The more severe test with 30% strength (instead of 20% strength) sodium hydroxide solution, and otherwise identical conditions to those described for Examples 1 to 11, is only withstood by the most effective of the solubilizers, compare Table II.

Table II

| Surfactant | Comparative experiment: Ethylhexanoic acid/oleic acid-MA adduct 1:9(by weight) | Examples: 12. Caproic acid | 13. Cyclohexanecarboxylic acid | 14. Ethylhexanoic acid | 15. Isononanoic acid (technical isomer mixture) | 16. Capric acid | 17. Undecylenic acid | 18. Benzoic acid | 19. p-Toluic acid | 20. Naphthalenecarboxylic acid | 21. Ethylhexanoic acid/oleic acid-MA adduct 9:1 (by weight) | 22. Ethylhexanoic acid/oleic acid-MA adduct 1:1(by weight) |
|---|---|---|---|---|---|---|---|---|---|---|---|---|
| Triethanolamine + 15 EO + 43 PO | − | − | − | + | − | − | − | − | − | − | + | slightly cloudy |
| ED + 52 PO + 160 EO | − | − | − | − | − | − | − | − | − | − | + | − |
| 30 PO + 150 EO | − | − | − | − | − | − | − | − | − | − | + | − |
| $C_{9/11}$-Oxo alcohol + 7 EO + 1 butylene oxide | − | − | − | + | − | − | − | − | − | − | + | − |
| $C_{9/11}$-Oxo-alcohol + 10 PO | − | − | − | − | − | − | − | − | − | − | + | − |
| $C_{13/15}$-Oxo alcohol + 3 EO | − | − | − | + | − | − | − | − | − | − | + | slightly cloudy |

x EO + y PO means that y moles of propylene oxide have undergone adduct formation with a polymer of x moles of ethylene oxide
+ = clear solution
− = cloudy solution
P = paste which gives a clear solution on dilution
oleic acid-MA adduct = adduct of 1 mole of maleic anhydride with 1 mole of oleic acid
1:1(by weight) = mixture of two equal amounts by weight

We claim:

1. A process for the preparation of a strongly alkaline, aqueous solution of a nonionic surfactant by mixing the surfactant, aqueous sodium hydroxide solution and a solubilizer and if necessary diluting with water, wherein the solubilizer is a mixture of a monocarboxylic acid of 6 to 11 carbon atoms and from 0.05 to 1 part by weight per part by weight of monocarboxylic acid of an ene-adduct of maleic anhydride with an unsaturated fatty acid of 12 to 24 carbon atoms or a triglyceride thereof, the weight ratio solubilizer:surfactant being from 1:1 to 10:1.

2. A process as claimed in claim 1, wherein the monocarboxylic acid is 2-ethylhexanoic acid.

3. A process as claimed in claim 1, wherein the ene-adduct is an adduct of maleic anhydride and oleic acid.

4. A process as claimed in any of claims 1, 2 or 3, wherein the nonionic surfactant is an adduct of ethylene oxide and/or proplyene oxide with an alcohol, amine, carboxylic acid, acid amide or alkylphenol or a block copolymer of ethylene oxide with propylene oxide and/or butylene oxide.

5. A clear, strongly alkaline aqueous solution of a nonionic surfactant containing from 1 to 10 parts by weight, per part by weight of nonionic surfactant, of a monocarboxylic acid of 6 to 11 carbon atoms or of a mixture of such a carboxylic acid with from 5 to 100% of its weight of an ene-adduct of maleic anhydride with an unsaturated fatty acid of 12 to 24 carbon atoms or a triglyceride thereof.

* * * * *